US007270260B1

(12) United States Patent
Powers

(10) Patent No.: US 7,270,260 B1
(45) Date of Patent: Sep. 18, 2007

(54) MAIL ALERT FLAG

(76) Inventor: W H Powers, 1020- 49th Ave. East, Bradenton, FL (US) 34203

( * ) Notice: Subject to any disclaimer, the term of this patent is extended or adjusted under 35 U.S.C. 154(b) by 0 days.

(21) Appl. No.: 11/786,080

(22) Filed: Apr. 10, 2007

(51) Int. Cl.
*A47G 29/12* (2006.01)

(52) U.S. Cl. ..... 232/35

(58) Field of Classification Search ..... 232/35, 232/34, 17; D99/29; 116/303
See application file for complete search history.

(56) References Cited

U.S. PATENT DOCUMENTS

| | | | | | |
|---|---|---|---|---|---|
| 2,483,992 | A | * | 10/1949 | Young | 232/35 |
| 2,730,298 | A | * | 1/1956 | Haserodt | 232/35 |
| 2,874,895 | A | * | 2/1959 | Opp et al. | 232/35 |
| 3,095,140 | A | * | 6/1963 | Buedingen | 232/35 |
| 3,102,684 | A | * | 9/1963 | Eging | 232/35 |
| 3,143,287 | A | | 8/1964 | Holt | |
| 3,338,511 | A | * | 8/1967 | Cvar | 232/35 |
| 4,702,411 | A | * | 10/1987 | Yager | 232/35 |
| 4,840,307 | A | * | 6/1989 | Hartman | 232/35 |
| D314,852 | S | * | 2/1991 | Taylor | D99/29 |
| 5,076,337 | A | | 12/1991 | Reuter | |
| 5,082,170 | A | * | 1/1992 | Goss | 232/35 |
| 6,065,671 | A | * | 5/2000 | Stepleton | 232/35 |

* cited by examiner

*Primary Examiner*—William L. Miller

(57) ABSTRACT

A two-part mail delivery alert flag with a spring-loaded hinge and a signal flag member having a bent tailpiece, a broad width dimension, and a narrowed distal end that is inserted between the mailbox's outside surface and the lip of its door, when the door is fully closed. After a mail carrier approaches the mailbox and opens the door, the signal flag member is immediately released and rotates into an easily visible deployed position substantially perpendicular to the mailbox's outside surface. The mail alert flag operates independently from the flag typically used on the right side of a mailbox to alert the mail carrier to the presence of outgoing mail. Further, it can be mounted in almost any top or lateral position on the outside surface of the mailbox where it would be readily visible to the person typically expected to monitor mail delivery from a remote location.

15 Claims, 6 Drawing Sheets

MAIL ALERT FLAG

CROSS-REFERENCES TO RELATED APPLICATIONS

None

BACKGROUND

1. Field of the Invention

This invention relates to the field of mail indicator flags on mailboxes, specifically to a two-part mail delivery alert flag with a spring-loaded hinge and a one-piece signal flag member having a bent tailpiece, a broad width dimension relative to its overall length, and a narrowed distal end that is configured so that prior to mail delivery it can be easily tucked between the outside surface of a mailbox and the rim on the top and sides of the mailbox door that follows the contour of the generally inverted U-shape of the mailbox's outside surface. This places the flag member in an out-of-the-way position close to the outside surface of the mailbox prior to deployment. When a mail carrier approaches the mailbox and opens the door, the present invention mail flag is immediately released solely as a result of the door opening and one does not have to rely on the mail carrier to remember to deploy the present invention mail alert flag. When fully rotated into its desired position of use, the present invention signal flag is substantially perpendicular to the portion of the mailbox's outside surface to which it is attached, where it is easily visible to a remote observer since it also is oriented so that its broad width dimension is substantially perpendicular to the longitudinal axis of the mailbox. It operates independently from the flag typically used on the right side of a mailbox to alert a mail carrier to the presence of outgoing mail. Further, the present invention mail alert flag can be mounted in almost any top or lateral position on the outside surface of the mailbox where it would be readily visible after activation by the person typically expected to monitor mail delivery. Bright color for the present invention mail alert flag is preferred, but optional. The present invention can be manufacturer installed, or retrofitted to an existing mailbox. Since it is simple in design and construction, and has the advantages of being easily and cost-effectively constructed from readily available materials, the present invention can also be economically manufactured.

2. Description of the Related Art

Many mail arrival alert devices are known for mailboxes. In U.S. Pat. No. 5,076,337 to Reuter (1991) a signal flag is disclosed that is mounted on a spring activated spool rotatably secured within a housing affixed to the side of the mailbox opposed from the pick-up flag, with the signal flag held under tension in a horizontal position by a keeper mounted on the mailbox door. When a mail carrier opens the mailbox door to deposit incoming mail, the signal flag is released and immediately rotated into a vertical orientation. The Reuter invention has several disadvantages, including the limitation of mounting in only one position on the mailbox (unless modification occurs), and there is limited visibility of the signal flag from a position rearward to the mailbox (where one is often situated while awaiting mail delivery) as the signal flag does not turn flat-side-out into a position perpendicular to the longitudinal axis of the mailbox surface. Similarly, U.S. Pat. No. 3,143,287 to Holt (1964) discloses a mailbox signal device that is limited to one position on a mailbox (unless modification occurs), and may not be visible to a person watching for mail delivery from a position rearward and to the right of the mailbox, if that happens to be the typical vantage point for a person watching for mail delivery. The Holt signal flag is mounted on the side of the mailbox opposed from the pick-up flag, in a position close to the mailbox door. In its position of non-use (prior to mail delivery), the flag extends out from the mailbox surface in a perpendicular orientation, with a small tab tucked under the closed mailbox door. When a mail carrier opens the mailbox door to deposit incoming mail, the tab holding the signal flag in its pre-delivery vertical position is released and immediately gravity causes the signal flag to rotate in a downwardly direction until it reaches a substantially horizontally extending position. Another disadvantage of the Holt signal flag is that it is visible at all times (up or down), which might be confusing to a mail carrier, particularly when the pick-up flag mounted to the other side of the mailbox is also raised, and also depending upon what direction the mail carrier uses to approach the mailbox. Further, the Holt signal flag also has the disadvantages of sticking out from the mailbox, and not laying flat against it when not in use, where it may be a source of contact injury if someone walks too close to the mailbox on that side. In addition, U.S. Pat. No. 2,483,992 to Young (1948) discloses a signal attachment for rural mailboxes with an elongated metal strap on its upper side that is configured with a bend in its distal end to assist in maintaining the mailbox door in a closed position. The Young invention is secured to this strap with a channel-shaped supporting member, so that no holes are needed through the mailbox surface. Thus, the Young mail delivery signaling device has the disadvantage of only being attachable to the top of a mailbox, at the site of the needed strap. A further disadvantage is that many modern mailboxes no longer use any type of strap or bracket to assist in maintaining the door in a closed position. The Young device also has a small tab that prior to mail delivery is tucked under the edge of the mailbox door on one side of the strap, with the tab being released as a mail carrier opens the door to insert incoming mail. When the tab is thus released, a spring rotates the signal flag into a substantially upright position above the mailbox surface. In addition to its mounting limitation, other disadvantages of the Young mail delivery signal device are that the channel member that is fixed to the mailbox strap is not adjustable and does not fit on straps of differing width, it has multiple parts that are expensive to manufacture and market, and it is conspicuous even when not activated. In contrast, the present invention can be mounted on the sides or top of a mailbox in an out-of-the-way position, and according to user preference or wherever it is determined that the signal flag member would be readily visible from the remote vantage point used most often for mail delivery monitoring. For example, if the person waiting for mail delivery is typically looking at the mailbox from a kitchen window directly behind the mailbox, top mounting of the present invention might be preferred, whereas if the typical vantage point of the person waiting for mail delivery was from a study window to the left and rearward from the mailbox, left mounting of the present invention might be preferred for optimal viewing. The present invention is simple in design for economical manufacture and marketing, having only two parts, the first part being a spring-loaded hinge (any spring-loaded hinge commonly available as a hardware item can be used), and the other part being a rigid and preferably thin one-piece flag member with a broad width dimension, a narrowed distal end, and a bent tailpiece that acts as a stop and allows the flag member to achieve and maintain a substantially perpendicular orientation relative to the mailbox surface adjacent to it after deployment, when its narrowed distal end is released by a mail carrier opening the mailbox door. The narrowed distal end is configured for rapid, easy, and repeated insertion between the outside surface of a mailbox and the rim on the top and sides of the mailbox door that follows the contour of the generally inverted U-shape of the mailbox's outside surface, and as a result of such insertion the present invention flag remains in an out-of-the-way and substantially non-visible position flat adjacent to the mailbox's outside surface until it is needed to provide a signal that mail delivery has occurred. No other mail alert flag is known that has exactly the same structure, functions in the same manner, has the same economical manufacture, or provides all of the advantages of the present invention.

BRIEF SUMMARY OF THE INVENTION

The primary object of this invention is to provide a mail delivery alert flag of simple design and cost-effective manufacture that is activated solely by release of the mailbox door. It is also an object of this invention to provide a mail delivery alert flag that can be mounted in a variety of user-selected positions on the outside surface of a mailbox for maximum visibility by a remotely located person routinely monitoring mail delivery from a typical vantage point. It is a further object of this invention to provide a mail delivery alert flag that can be attached to any mailbox with a door lip, and not just those with a top strap or bracket that assists in maintaining door closure. Another object of this invention is to provide a mail delivery alert flag with durable waterproof construction. A further object of this invention is to provide a mail delivery alert flag that does not require complex manufacturing steps and can be made from readily available materials. It is also an object of this invention to provide a mail delivery alert flag that can be mounted during mailbox manufacture, easily applied by the user to a newly purchased mailbox, or retrofitted by the user or others to an existing mailbox.

The present invention, when properly made and used, will provide a two-part mail delivery alert flag that can be mounted on the sides or top of a mailbox, wherever it would be most visible to the person typically expected to monitor mail delivery. It is simple in design for economical manufacture and marketing, having only a spring-loaded hinge as a first part (any spring-loaded hinge commonly available as a hardware item is contemplated for use), with a second part in the form of a rigid and preferably thin one-piece flag member with a broad width dimension relative to its overall length dimension, a narrowed distal end, and a bent tailpiece that acts as a stop and allows the flag to achieve and maintain a substantially perpendicular orientation relative to the portion of the mailbox's outside surface adjacent to it, once the narrowed distal end is released by a mail carrier opening the mailbox door. With its broad width dimension, the present invention signal flag is easy visible when deployed, and its preferred thin configuration makes it easy to conceal prior to deployment in an out-of-the-way and substantially non-visible position adjacent to the mailbox's outside surface, where it will not injure, interfere with, or otherwise significantly impede a person's movement around the mailbox. The narrowed distal end is configured for rapid, easy, and repeated insertion between the outside surface of a mailbox and the rim on the top and sides of the mailbox door that follows the contour of the generally inverted U-shape of the mailbox's outside surface, and as a result of such insertion the present invention flag is able to remain in an out-of-the-way position adjacent to the mailbox until it is needed to provide a signal to a remote observer that mail delivery has occurred. No other mail alert flag is known that has exactly the same structure, functions in the same manner, or provides all of the advantages of the present invention.

The description herein provides preferred embodiments of the present invention but should not be construed as limiting its scope. For example, variations in the thickness dimensions of the mail alert flag and the hinge, the length and width dimensions of the mail alert flag; the length dimension of the distal end of the mail alert flag, the number of hinge mounting holes used to secure the mail alert flag to the hinge, and the type of fasteners used to secure the mail alert flag to the hinge, as well as secure the hinge to the mailbox, other than those shown and described herein, may be incorporated into the present invention. Thus, the scope of the present invention should be determined by the appended claims and their legal equivalents, rather than being limited to the examples given.

DETAILED DESCRIPTION OF PREFERRED EMBODIMENTS

Figure 10:
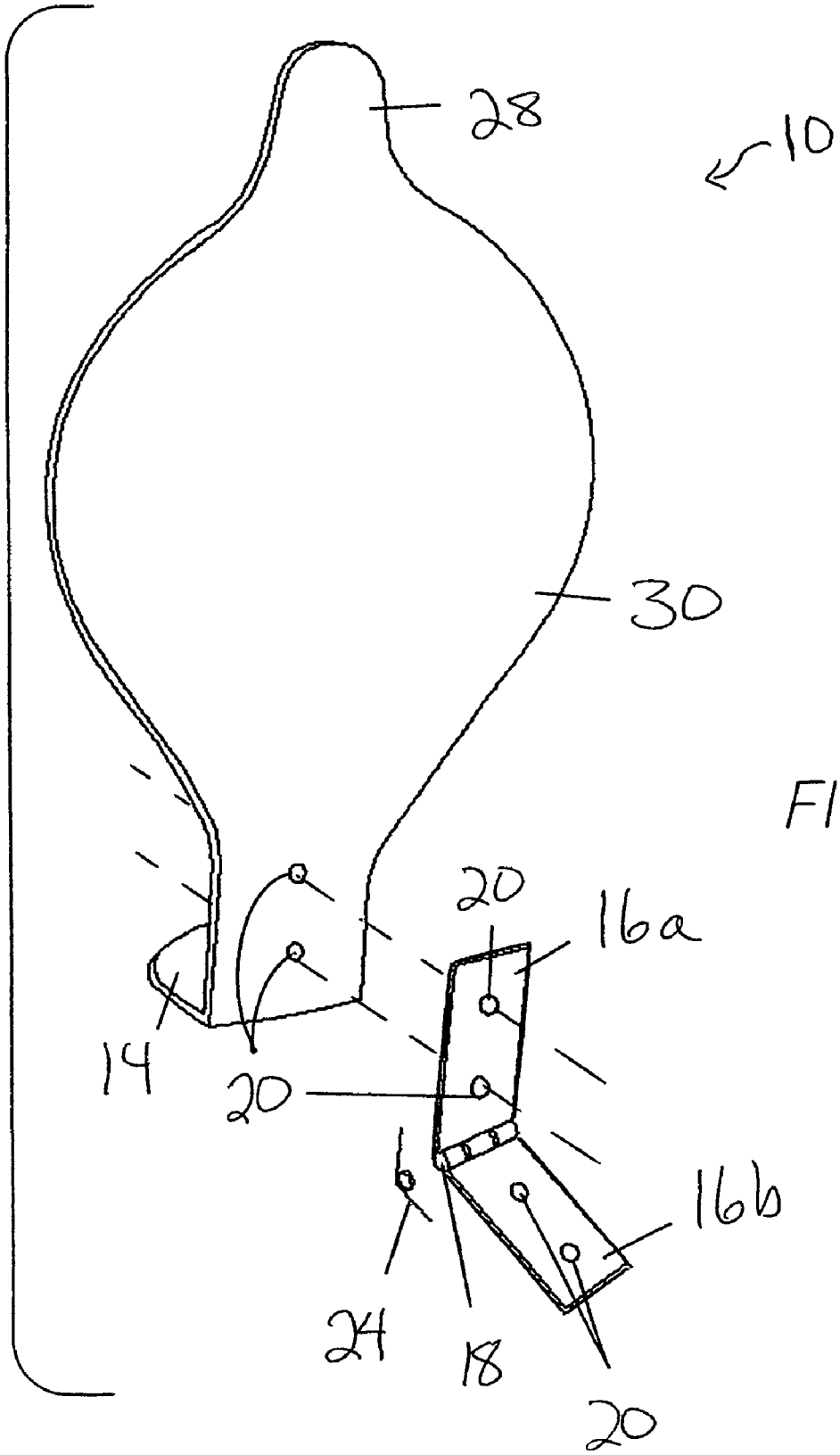
FIG. 10 is an exploded view of the most preferred embodiment of the present invention showing its mail alert flag and spring-loaded hinge, with the spring shown separately from the hinge for visual clarity, and also with broken lines aligning holes in the flag and hinge that would be connected to one another during use.

The present invention provides a two-part mail delivery alert flag 2 with a spring-loaded hinge 16 and a signal flag member 10. Hinge 16 is not limited to the configuration shown, and in the alternative can comprise any spring-loaded hinge commonly found as a hardware item. As shown in FIG. 10, it is typically contemplated for spring-loaded hinge 16 to have a hinge member 16*a* that is connected to signal flag member 10, a hinge member 16*b* that is secured a mailbox 6, a spring 24, and a hinge pin 18. Further, it is contemplated for signal flag member 10 to typically have a central portion 30 with a broad width dimension relative to its overall length dimension, a bent tailpiece 14 configured to act as a stop to achieve and maintain a deployed position of central portion 30 substantially perpendicular to the surface of mailbox 6, and a narrowed distal end 28 that is configured so that prior to mail delivery it can be easily inserted between the outside surface of a mailbox 6 and the lip 8 on the top and sides of the connected mailbox door 4 that follows the inverted U-shape contour of the outside surface of mailbox 6. If needed, distal end 28 can be slightly bent, or lip 8 stretched, or both, so that lip 8 is easily able to accommodate and temporarily secure distal end 28 prior to each repeat deployment. When a mail carrier (not shown) approaches a mailbox 6 having the present invention 2 connected to it and the mail carrier opens door 4, the signal flag member 10 is immediately released solely as a result of the opening of door 4, and rotates into a highly-visible deployed position substantially perpendicular to the portion of the outside surface of mailbox 6 to which it is attached. Reliance upon the mail carrier to remember to deploy signal flag member 10 is not required. In addition, in its deployed position the broad width dimension of signal flag member 10 is also substantially perpendicular to the longitudinal axis of mailbox 6 for optimum visibility to the person viewing mailbox 6 from a remote position. The present invention mail alert flag 2 operates independently from the flag (not shown) typically used on the right side of a mailbox 6 to alert the mail carrier to the presence of outgoing mail in the box needing pick-up. The outgoing mail indicator flag can have smaller length and width dimensions than present invention 2, as the mail carrier needing to view an outgoing mail indicator flag is typically within a few feet of mailbox 6, whereas after its deployment present invention 2 is typically observed from a much greater distance. Further, the present invention mail alert flag 2 can be mounted in almost any top or lateral position on the outside surface of a mailbox 6 where it would be most readily visible from the typical vantage point of the person usually monitoring mail delivery. A bright color or colors for the present invention signal flag member 10 is preferred, but optional. Texture and/or designs can also be used as decorative accents, although not represented in the accompanying illustrations. Further, although a thin and flat signal flag member 10 is most preferred so that it can be easily concealed in an out-of-the-way position adjacent to mailbox 6 and not be so bulky as to restrict a person's movement around mailbox 6, it is also optional for signal flag member 10 to have a contoured upper surface or other three-dimensional configuration.

Figure 1:
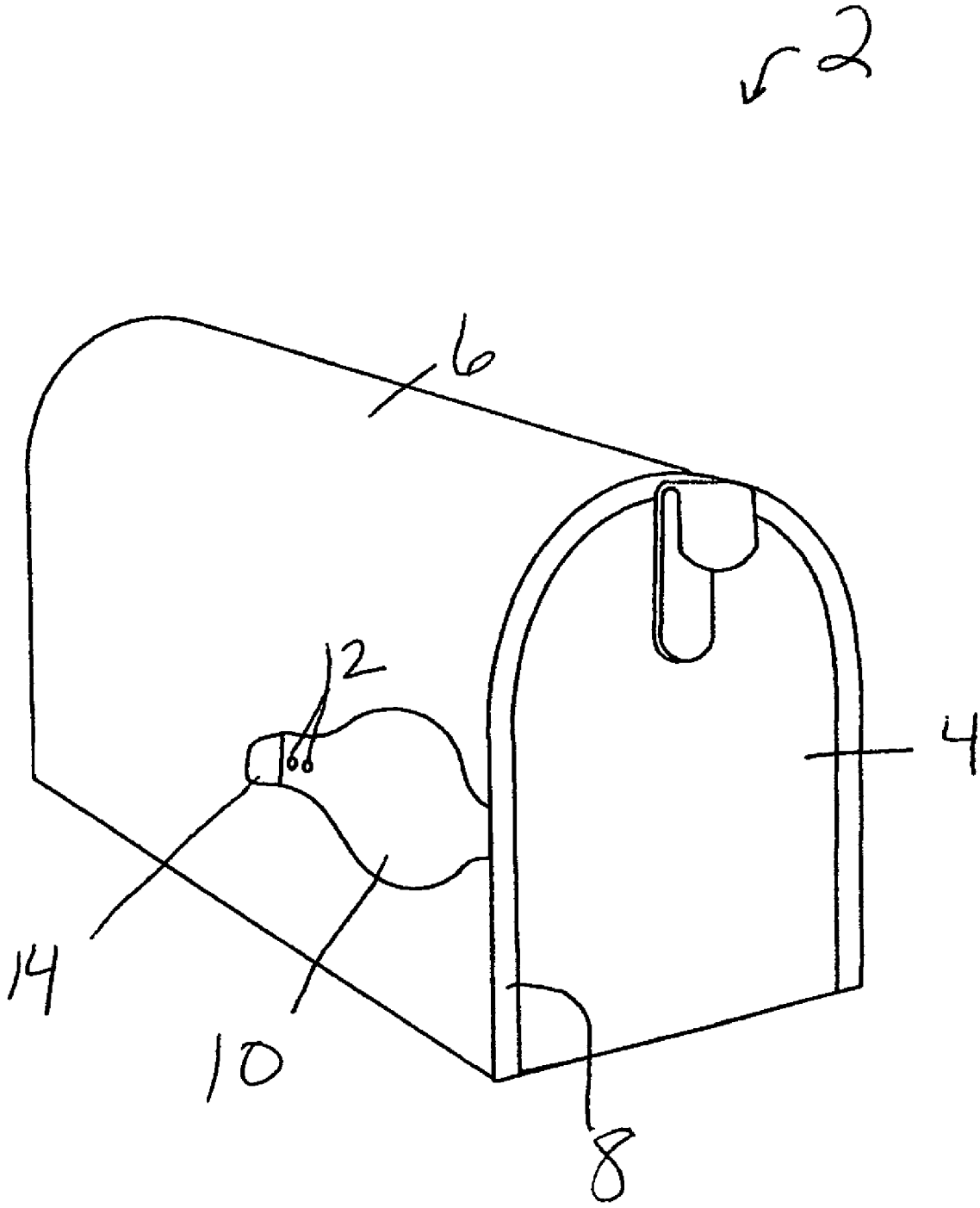
FIG. 1 is a perspective view of the most preferred embodiment of the present invention mounted in a first position on the left side of a mailbox, with its distal end tucked under the rim of the closed mailbox door.
Figure 2:
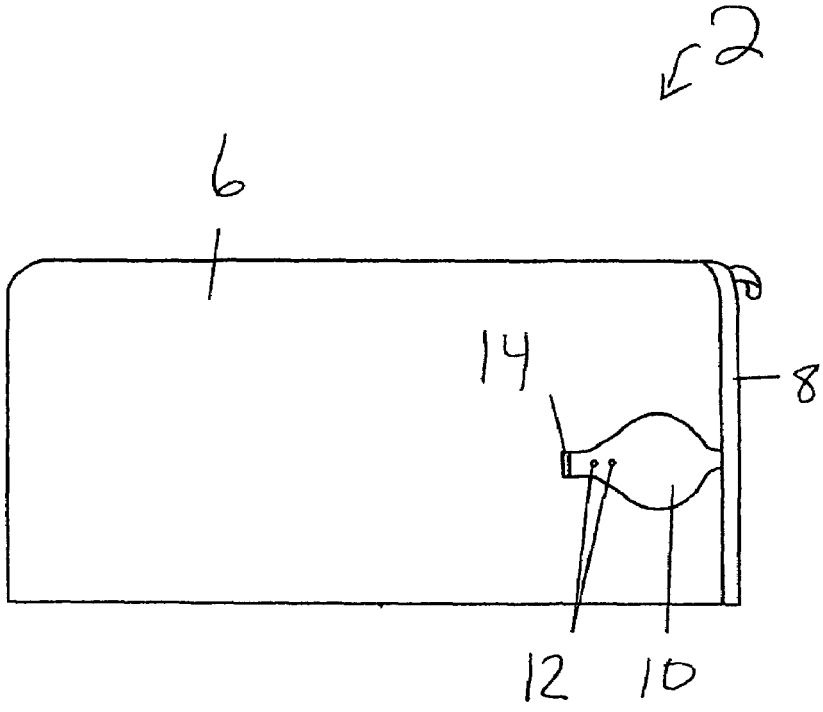
FIG. 2 is a side view of the most preferred embodiment of the present invention mounted in the first position and with its distal end tucked under the rim of the closed mailbox door.
Figure 3:
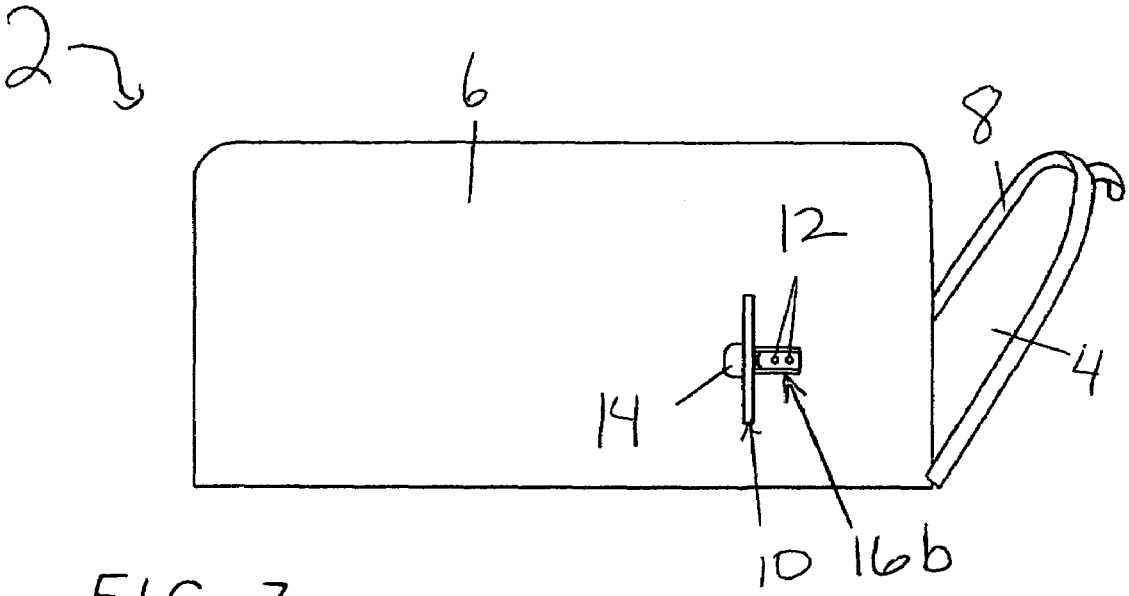
FIG. 3 is side view of the most preferred embodiment of the present invention mounted in the first position and with the mailbox door opened, the distal end of the mail alert flag released from its pre-delivery position, and the mail alert flag rotated into a deployed position approximately perpendicular from the portion of the mailbox's outside surface to which it is attached.
Figure 7:
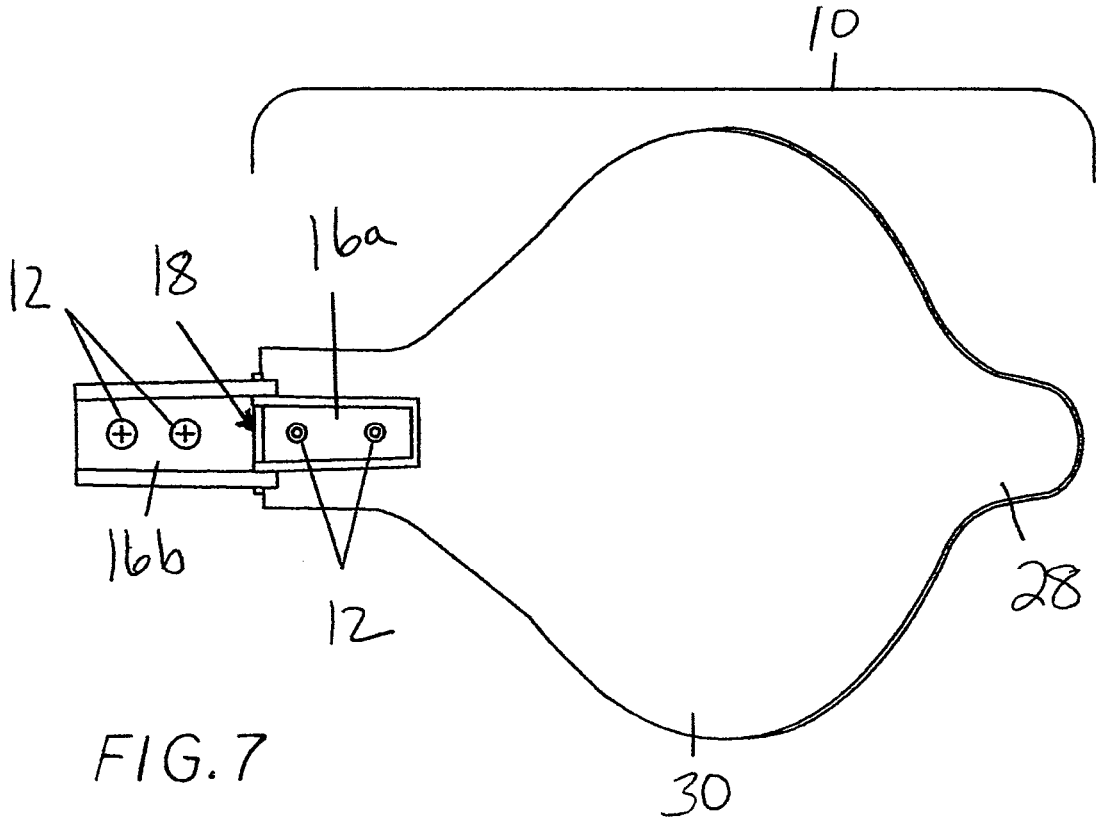
FIG. 7 is rear view of the most preferred embodiment of the present invention showing one half of a hinge attached to the signal flag in a position remote from its distal end.

FIGS. 1-3 show the most preferred embodiment of the present invention 2 having its signal flag member 10 mounted in a first preferred position on the left side of a mailbox 6. FIGS. 1 and 2 show the tapered distal end 28 (visible in FIGS. 7-10) of signal flag member 10 inserted between the outside surface of mailbox 6 and the lip 8 of its door 4, which places signal flag member 10 in an unnoticed and out-of-the-way position very close to the outside surface of mailbox 6 prior to mail delivery, where a remote viewer of mailbox 6 would not be able to easily see it. In contrast, FIG. 3 shows door 4 in an opened position with lip 8 separated from mailbox 6, and signal flag member 10 rotated into a highly-visible deployed position substantially perpendicular to the portion of mailbox 6 to which signal flag member 10 is attached. Not only is signal flag member 10 generally perpendicular to mailbox 6 in its deployed orientation, its visibility is further enhanced by its broadest width dimension being substantially perpendicular to the longitudinal axis of mailbox 6. FIGS. 1 and 2 further show the tailpiece 14 of signal flag member 10 in a position extending outward from and substantially perpendicular to the outside surface of mailbox 6, while FIG. 3 shows tailpiece 14 in a substantially parallel relation to the outside surface of mailbox 6 where it is functioning as a stop to prevent further rotation of the deployed signal flag member 10 after its release and maintain the enlarged central portion 30 (shown in FIGS. 7-10) of signal flag member 10 in a highly-visible and substantially perpendicular orientation relative to the area on mailbox 6 where signal flag member 10 is securely connected. In addition, FIGS. 1 and 2 show two fasteners 12 being used to connect one portion of spring-loaded hinge 16 to signal flag member 10 (although hinge member 16*a* is hidden in FIGS. 1 and 2, it is shown in FIG. 7), while FIG. 3 shows two additional fasteners 12 being used to connect the second portion of spring-loaded hinge 16 (hinge member 16*b*) to mailbox 6. The number of fasteners 12 used is not critical, however, the number used should not be so excessive as to weaken the connection of hinge member 16*b* to mailbox 6 or hinge member 16*a* to signal flag member 10, or needlessly inflate manufacturing and/or installation costs. The type of fastener 12 used is also not critical, although screws, pop rivets, and bolts are preferred, with the selection made according to user preference. When a screw or other fastener 12 used has a blunt end, the orientation of fasteners 12 is not a concern. However, when fasteners 12 have a sharp end, it is preferred for the sharp end of fasteners 12 connecting signal flag member 10 to hinge member 16*a* to be placed on the side of signal flag member 10 facing mailbox 6 before deployment, and for the sharp end of fasteners 12 connecting hinge member 16*a* to mailbox 6 to be placed within mailbox 6. Precautions against the sharp end of a fastener 12 scratching or otherwise injuring a person delivering or picking up mail can include but are not limited to, placing sufficient tape or putty-like substance over the sharp end to eliminate it as a source of harm.

Figure 4:
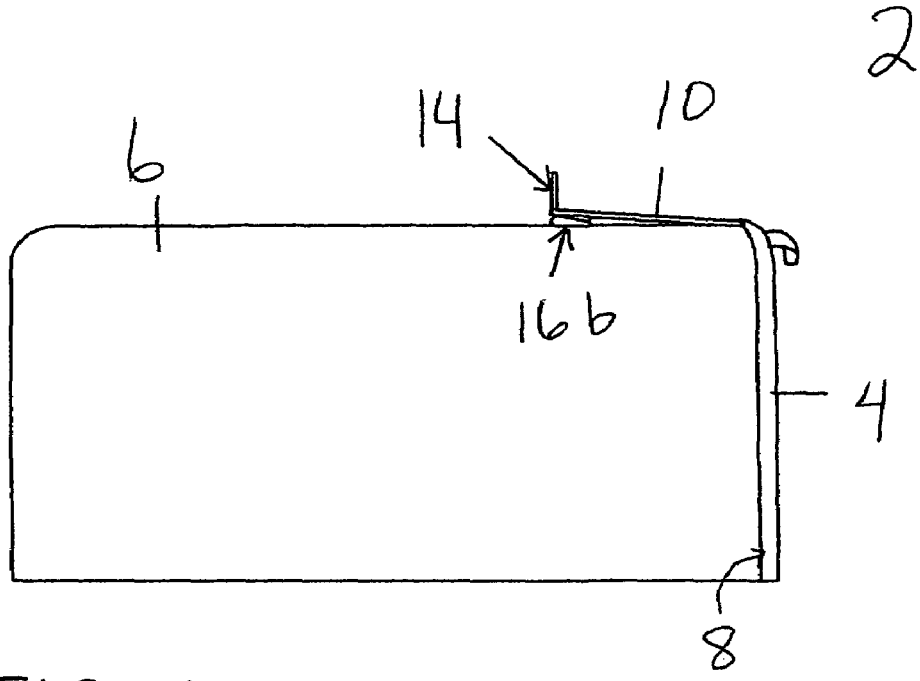
FIG. 4 is a perspective view of a second preferred embodiment of the present invention mounted in a second position on the top of a mailbox, with its distal end tucked under the rim of the closed mailbox door.
Figure 5:
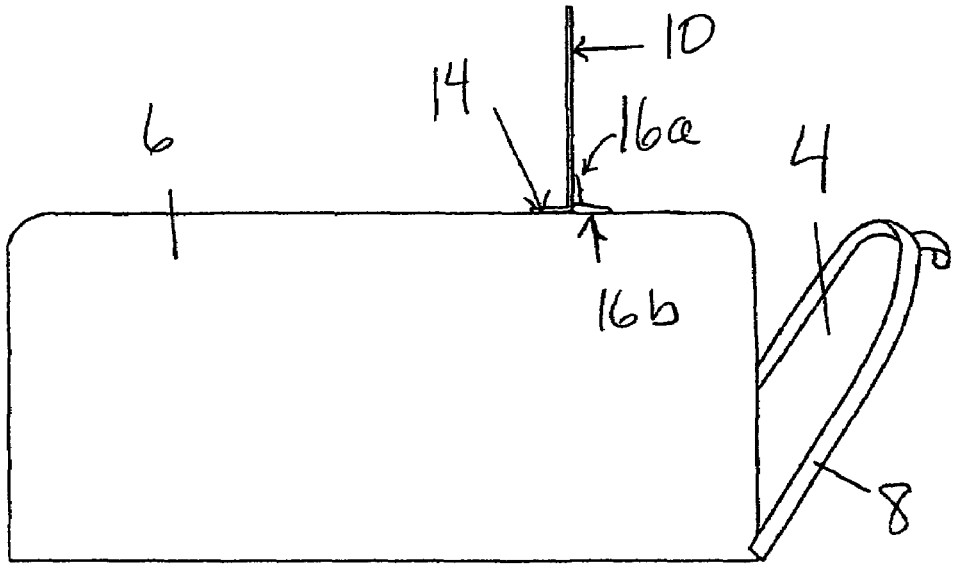
FIG. 5 is side view of the second preferred embodiment of the present invention mounted in the second position and with the mailbox door opened, the distal end of the mail alert flag released from its pre-delivery position, the mail alert flag rotated into a position substantially perpendicular from the mailbox outside surface to which it is attached, and the broadest width dimension of the mail alert flag in its deployed position substantially perpendicular to the longitudinal axis of the mailbox.

Similarly, FIGS. 4 and 5 show the most preferred embodiment of the present invention 2 having its signal flag member 10 mounted in a second preferred location on the top of mailbox 6. FIG. 4 shows the tapered distal end 28 (shown in FIGS. 7-10) of signal flag member 10 inserted between the outside surface of mailbox 6 and the lip 8 of its door 4, which places the thin signal flag member 10 in an unnoticed position and out-of-the-way position very close to the top surface of mailbox 6 prior to mail delivery. In contrast, FIG. 5 shows door 4 in an opened position with lip 8 separated from mailbox 6, and signal flag member 10 rotated into a highly-visible deployed position substantially perpendicular to the top of mailbox 6. FIG. 4 further shows the tailpiece 14 of signal flag member 10 in a position extending upward from and substantially perpendicular to the top surface of mailbox 6, while FIG. 5 shows tailpiece 14 positioned against and substantially parallel to the top surface of mailbox 6 where it acts as a stop to prevent further rotation of the deployed signal flag member 10 after its release and maintain the enlarged central portion 30 (shown in FIGS. 7-10) of signal flag member 10 in a highly-visible and substantially perpendicular orientation relative to the top surface of mailbox 6. As in FIGS. 1-3, in, FIGS. 4 and 5 show signal flag member 10 not only being generally perpendicular to mailbox 6 in its deployed orientation, but also the broadest width dimension of signal flag member 10 being substantially perpendicular to the longitudinal axis of mailbox 6 for even greater visibility. In addition, FIGS. 4 and 5 show a two-part spring-loaded hinge 16*a*/16*b* being used to connect signal flag member 10 to mailbox 6, with FIG. 5 showing hinge member 16*b* connected to mailbox 6 and hinge member 16*b* secured to signal flag member 10.

Figure 6:
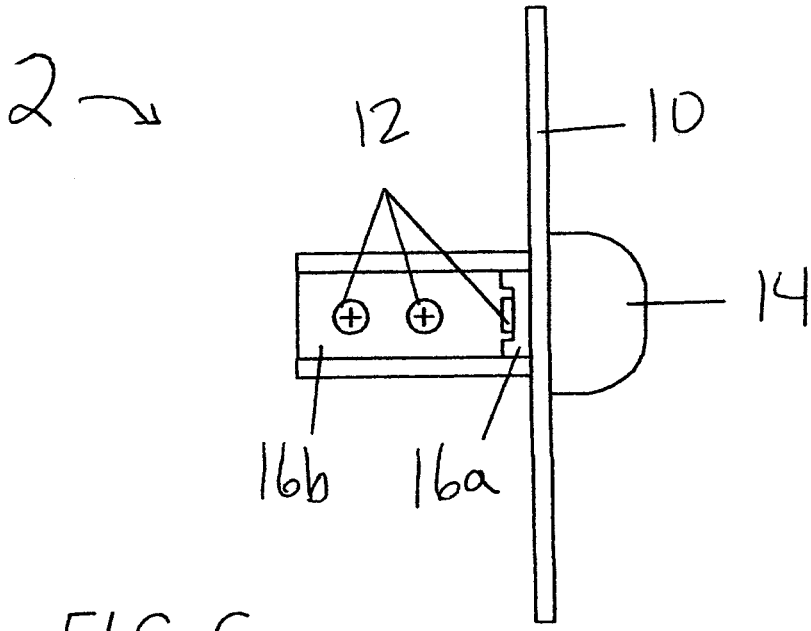
FIG. 6 is a top view of the most preferred embodiment of the present invention in a deployed position that uncovers its hinge and fasteners used to secure hinge-to-mailbox and hinge-to-flag connections, and also shows the tailpiece that functions as a stop to place the fully deployed mail alert flag in a substantially perpendicular position to the outside surface of the mailbox to which it is attached.

FIG. 6 is a top view of the most preferred embodiment of the present invention signal flag member 10 in a released position independent from mailbox 6 that reveals the two parts 16*a* and 16*b* spring-loaded hinge 16, which prior to deployment of signal flag member 10 were hidden from view. FIG. 6 also reveals two mounting fasteners 12 connecting hinge member 16*b* to mailbox 6 and one mounting fastener 12 securing hinge member 16*a* to signal flag member 10. Although not shown, it is contemplated for at least one additional fastener 12 to be positioned out of view, in alignment with and below the visible fastener 12 adjacent to hinge member 16*a*. FIG. 6 also shows the bent portion of signal flag member 10 forming tailpiece 14 that functions as a stop to place the fully deployed signal flag member 10 in a substantially perpendicular position relative to the area on the outside surface of mailbox 6 to which it is attached. FIG. 6 also shows signal flag member 10 preferably having a small and uniform thickness dimension. However, a thicker signal flag member 10, with or without uniform thickness dimension, may also be used, particularly where texture or other decorative accent is desired. Therefore, the relative dimensions of signal flag member 10 shown in FIG. 6 should not be considered as limiting to the scope of present invention 2. Further, as mentioned before, it is contemplated for hinge member 16*a*/16*b* to comprise any spring-loaded hinge commonly available as a hardware item, and thus it is not contemplated for the configuration of hinge 16*a*/16*b* to be limited to that shown in FIG. 6. Also, the number of fasteners 12 used to secure hinge member 16*a* to signal flag 10, or hinge member 16*b* to mailbox 6, is not critical, although a minimum of two fasteners 12 in each application is preferred to provide secure and long-lasting connections.

Figure 8:
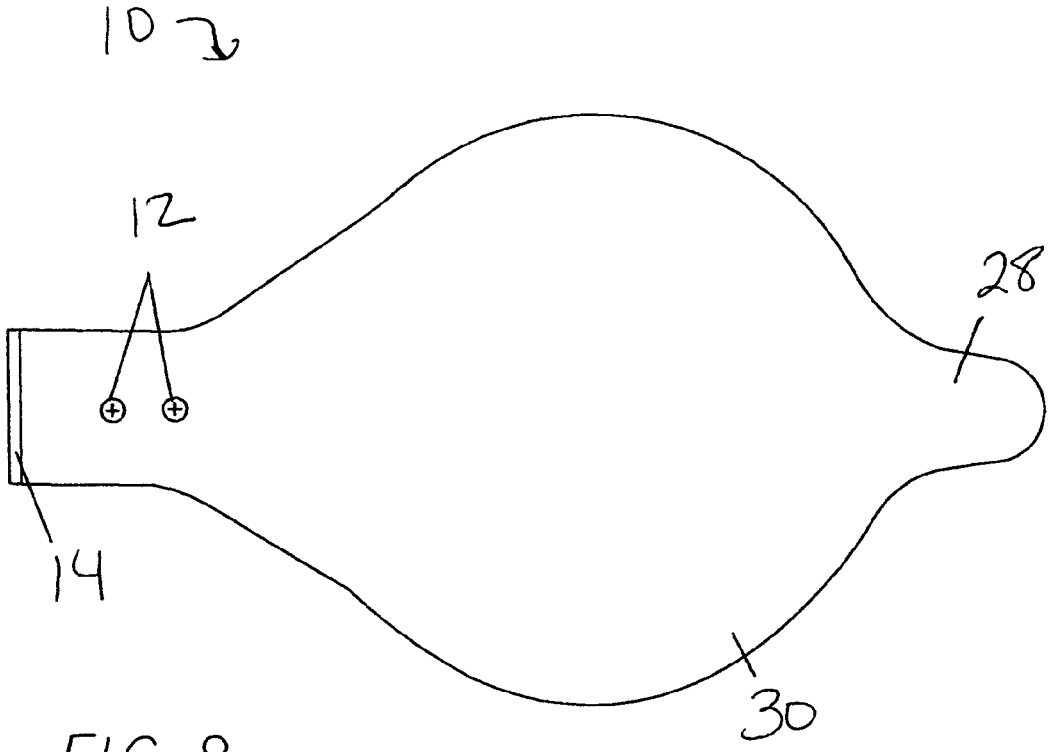
FIG. 8 is front view of the most preferred embodiment of the present invention showing mounting fasteners secured to the mail alert flag, and also showing the mail alert flag also having a rotational stop in a position remote from its distal end.
Figure 9:
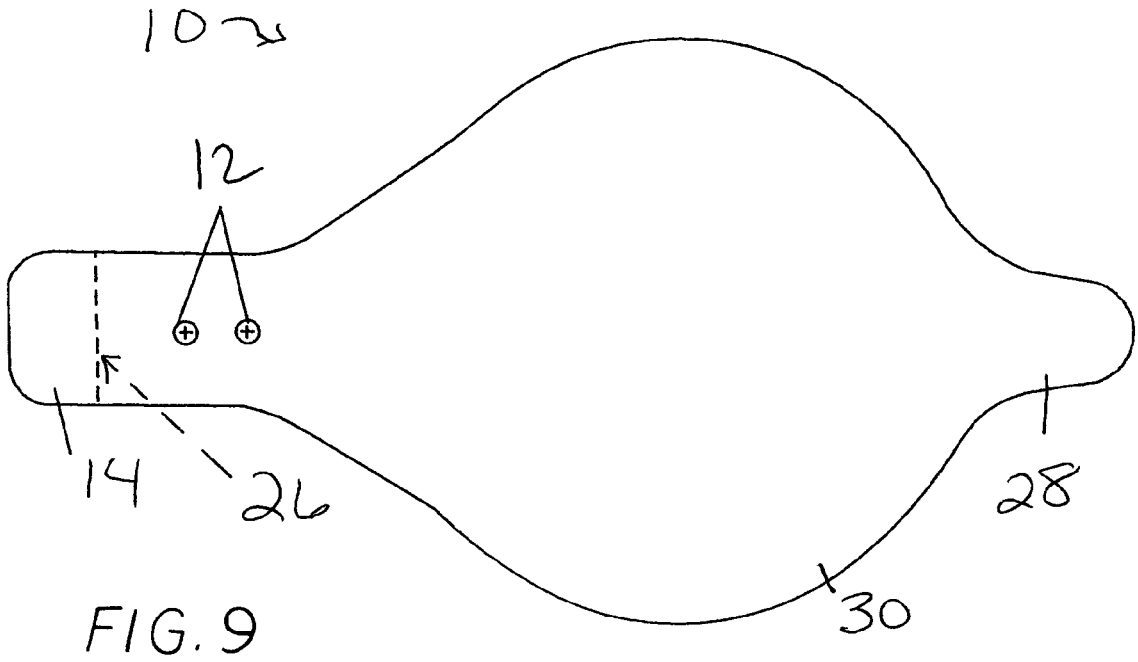
FIG. 9 is front view of the most preferred embodiment of the present invention showing mounting fasteners secured to the mail alert flag in a position remote from its distal end, with broken lines showing where the flag material would be bent to form the rotational stop.

FIGS. 7-10 show the most preferred embodiments of the present invention signal flag member 10 and the spring-loaded hinge 16*a*/16*b* that rotates signal flag member 10 from a first substantially unnoticed position adjacent to mailbox 6 into a second highly-visible deployed position substantially perpendicular to the surface of mailbox 6. The appearance of the distal end 28 of signal flag member 10 varies in FIGS. 7-10, with distal end 28 appearing more elongated in FIGS. 8 and 9. As it is also contemplated for other configuration variations for signal flag member 10 to be included within the scope of the present invention, the appended claims should be consulted for the limitations attributable to signal flag member 10. For example, the length and width dimensions of the central portion 30 and distal end 28 of signal flag member 10 are not critical, as long as they provide the amount of enhanced visibility needed by the person monitoring mail delivery from a typical vantage point. Preferably however, and for nearly all applications, it is contemplated for the maximum width dimension of central portion 30 to be at least half of the overall length dimension of signal flag member 10. FIG. 7 is rear view of the signal flag member 10 showing a first hinge member 16*a* adjacent to the central portion 30 in a position directly opposed to distal end 28. The mounting fasteners 12 used to fix hinge member 16*a* to signal flag member 10 may preferably include bolts, pop-rivets, and/or screws, but not limited thereto. However, if the type of fasteners 12 used has a sharp end, it is preferred for the smoother head of each fastener 12 to be placed adjacent to the side of signal flag member 10 exposed prior to deployment. Similarly, although not shown, if the fasteners 12 used to secure hinge member 16*b* to a mailbox 6 comprise screws, it is preferred for the smoother head of fastener 12 to be placed outside of mailbox 6 and for the excess amount of fastener 12 material that could become a hazard to a user be trimmed and/or covered by another material to protect the hands of mail carriers and people inserting their hands into mailbox 6 to retrieve mail (not shown). FIG. 7 also shows hinge member 16*b* and hinge member 16*a* being connected to one another via a hinge pin 18. FIG. 8 is a front view of the most preferred embodiment of signal flag member 10 showing two fasteners 12 engaging signal flag member 10 between central portion 30 and tailpiece 14, which is bent rearward to provide a rotational stop for signal flag member 10 when distal end 28 is released from its first position close to mailbox 6 and thereafter rotates into a highly-visible deployed position substantially perpendicular to the area on the outside surface of mailbox 6 to which signal flag member 10 is attached. Similarly, FIG. 9 is also front view of signal flag member 10 showing two fasteners 12 engaging the portion of signal flag member 10 between central portion 30 and tailpiece 14, with the broken lines 26 showing where the material of signal flag member 10 is preferably bent during manufacture to form the tailpiece 14 needed as a rotational stop. As previously mentioned, the number of fasteners 12 used and the configuration of signal flag member 10 are not limited to that shown in FIG. 9. FIG. 10 is an exploded view of the most preferred embodiment of the present invention showing the preferred configurations of signal flag member 10 and spring-loaded hinge 16*a*/16*b* with its spring 24 and hinge pin 18. The separate rendering of hinge 24 is solely for clarity of illustration. The configuration of spring-loaded hinge 16*a*/16*b* in FIG. 10 is different from that shown in FIGS. 3 and 6-7, as the edges of spring-loaded hinge 16*a*/16*b* in FIG. 10 have a flat appearance, whereas the edges of spring-loaded hinge 16*a*/16*b* in FIGS. 3 and 6-7 are upturned and give spring-loaded hinge 16*a*/16*b* a channeled appearance. Variations from the configurations shown in FIGS. 7-10 are also contemplated to be within the scope of the present invention, including spring-loaded hinge 16*a*/16*b* which can comprise any spring-loaded hinging means commonly available as a hardware item. Further, FIG. 10 shows two fastener mounting holes 20 through signal flag member 10, two fastener mounting holes 20 through hinge member 16*a*, two fastener mounting holes 20 through hinge member 16*b*, and broken lines extending through each fastener mounting hole 20 in signal flag member 10 and the corresponding fastener mounting hole 20 to which it is paired in hinge member 16*a*. One should consult the appended claims to determine the scope of configuration variations that can be included within the legal definition of the present invention.

Although not limited thereto, and provided only by way of example, one preferred embodiment of signal flag member 10 could have an overall length dimension of approximately six inches, including the tailpiece 14, with a width dimension at the broadest part of central portion 30 being approximately three inches. If the bent portion of signal flag member 10 that forms tailpiece 14 is approximately one-half-of-an-inch in length, the remaining length dimension of signal flag member 10 when it is fully deployed would be approximately five inches. Although signal flag member 10 should be sufficiently large for enhanced visibility by a person remotely positioned from the mailbox 6 to which signal flag member 10 is attached, and a width dimension that is at least half of its length dimension is preferred, its configuration and size are not critical as long as signal flag member 10 is not so large as to be readily visible by a remote viewer and provide confusion as to whether mail delivery has occurred. Also, signal flag member 10 may have accent markings that include patterns, texture, and/or variations in thickness dimension. Should several mailboxes 6 be positioned in a row, signal flag member 10 can be mounted on or closer to the top of mailbox 6. However, for cost-efficient manufacture and use of less material, a signal flag member 10 having a substantially rectangular proximal end (between tailpiece 14 and central portion 30), a tapered and arcuate distal end 28, and a rounded central portion 30 is preferred. A rounded central portion 30 is also preferred so that no sharp corners are present should signal flag member 10 be inadvertently released, or when signal flag member 10 is laid flat in a position close to the outer surface of mailbox 6 prior to the closing of door 4 over the open end of mailbox 6, with narrowed distal end 28 positioned between mailbox 6 and the lip 8 of door 4. Although not limited thereto, in the example identified above, it is contemplated for the substantially rectangular proximal end between tailpiece 14 and central portion 30 to have length and width dimensions respectively of approximately one-and-one-half inches and one inch, a central portion 30 having a length dimension of approximately four inches, and distal end 28 having a length dimension of approximately one inch. Further, as shown in FIG. 10 but not limited thereto, in the example identified above, it is preferred for two hinge mounting holes 20 configured for engaging fasteners 12 to be present in signal flag member 10 and extend in a substantially linear arrangement toward tailpiece 14. The type of fastener 12 used to connect spring-loaded hinge member 16*a* and signal flag member 10, or connect spring-loaded hinge member 16*b* and mailbox 6, is not critical as long as a secure, weatherproof, and long-lasting connection is made. Further, while signal flag member 10 can be made from any rigid material capable of resisting weathering elements, such as but not limited to aluminum, plastic, or tin, a brightly colored or otherwise easily visible surface decoration is preferred for maximum visibility and effective mail delivery notification. If plastic material is used, it should have UV-resistance capability. In addition, although it is contemplated for the material used for flag member 10 to be rigid, as needed to fit between the lip of door 4 and mailbox 6 it is contemplated for the distal end 28 of flag member 10 to be angled or bent, if needed for a best fit. The lip 8 on door 4 can also be bent outwardly or otherwise slightly stretched so as to fit snugly over distal end 28.

What is claimed is:

1. A mail delivery alert flag for a mail box having an outside surface and a front mail delivery door having a lip, the door being movable between a closed and opened position, and when viewed from the front door the outside surface also having a top, left side, and a right side, said mail delivery alert flag comprising:

a one-piece signal flag member with a central portion having a broad width dimension, a narrowed distal end that is configured for being inserted between the mailbox's outside surface and the lip of its door, and a bent tailpiece in a position opposed to said distal end and substantially perpendicular to said central portion, said tailpiece being configured and positioned to abut said outside surface of said mailbox to act as a stop to achieve and maintain a substantially perpendicular orientation of said flag member relative to the mailbox's outside surface after said distal end is released from the lip of the mailbox door;

spring-loaded hinge means adapted for secure connection between said flag member and the outside surface of the mailbox and also for rotation of said flag member between a first minimally noticeable pre-mail-delivery starting position, wherein said flag member is located in an out-of-the-way position close to the mailbox's outside surface, and a second highly-visible deployed position substantially perpendicular to the area on the mailbox's outside surface to which said flag member is attached, said broad width dimension of said flag member also being substantially perpendicular to the longitudinal axis of the mailbox, when said flag member is in said deployed position; and fastening means adapted for securely fixing a first part of said hinge means to said flag member and a second part of said hinge means to the mailbox in a location around the lip of the door that allows said distal end to be securely inserted between the lip of the door and the mailbox when the door is in its closed position, thereby also placing said flag member into said first minimally noticeable pre-mail-delivery starting position, and wherein opening the mailbox door causes release and rotation of said signal flag member into said second highly visible deployed position that signals the arrival of mail, with the mounting of said signal flag member being possible via said fastening means in any orientation around the lip of the door desired by the mail recipient for optimum visibility from a pre-selected vantage point.

2. The mail delivery alert flag of claim 1 wherein said signal flag member is brightly colored for enhanced visibility by a remotely positioned person.

3. The mail delivery alert flag of claim 1 wherein said signal flag when deployed has a minimum length dimension of approximately five inches.

4. The mail deliver alert flag of claim 1 wherein when said signal flag is deployed said central portion has a minimum width dimension of approximately three inches.

5. The mail delivery alert flag of claim 1 wherein said signal flag when deployed has a minimum length dimension of approximately five inches and said central portion has a minimum width dimension of approximately three inches.

6. The mail delivery alert flag of claim 1 wherein said distal end has a minimum length dimension of approximately one inch.

7. The mail delivery alert flag device of claim 1 wherein said distal end has an approximate length dimension of one inch.

8. The mail delivery alert flag of claim 1 wherein said fastening means comprises at least two hinge mounting holes through said flag member between said tailpiece and said central portion.

9. The mail delivery alert flag of claim 1 wherein said tailpiece has a length dimension of approximately one-half inch.

10. The mail delivers alert flag of claim 1 wherein said signal flag member has a maximum length dimension of approximately six inches.

11. The mail delivery alert flag of claim 1 wherein said central portion of said signal flag has a non-uniform width dimension.

12. The mail delivery alert flat of claim 1 wherein said central portion of said signal flag also has a perimeter configuration that is at least partially arcuate.

13. The mail delivery alert flag of claim 1 wherein said signal flag when deployed has a minimum length dimension of approximately five inches, said central portion has a minimum width dimension of approximately three inches, and said tailpiece has a length dimension of approximately one-half inch.

14. The mail delivery alert flag of claim 1 wherein said signal flag has a width dimension and a length dimension, and wherein said width dimension is at least half of said length dimension.

15. The mail delivery alert flag of claim 1 wherein said fastening means comprises fasteners selected from a group consisting of screws, bolts, and pop rivets.

* * * * *